US007783210B2

(12) United States Patent
Thayer et al.

(10) Patent No.: US 7,783,210 B2
(45) Date of Patent: Aug. 24, 2010

(54) LONG LIFE CLEANING SYSTEM WITH REPLACEMENT BLADES

(75) Inventors: Bruce E. Thayer, Webster, NY (US); Cheryl A. Linton, Webster, NY (US); Richard W. Seyfried, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 328 days.

(21) Appl. No.: 11/877,770

(22) Filed: Oct. 24, 2007

(65) Prior Publication Data

US 2009/0110416 A1 Apr. 30, 2009

(51) Int. Cl.
*G03G 21/00* (2006.01)

(52) U.S. Cl. ..... 399/34; 399/71; 399/123

(58) Field of Classification Search ..... 399/34, 399/71, 123, 343, 345, 350, 351; 15/1.51, 15/256.5, 256.51
See application file for complete search history.

(56) References Cited

U.S. PATENT DOCUMENTS 4,860,052 A * 8/1989 Ito et al. ..... 399/24
5,208,639 A 5/1993 Thayer et al.
5,264,904 A 11/1993 Audi et al.
5,546,165 A 8/1996 Rushing et al.
6,311,038 B1 * 10/2001 Schlueter et al. ..... 399/350
2003/0223789 A1 * 12/2003 Miyazaki ..... 399/327
2006/0001911 A1 1/2006 Viassolo et al.
2006/0115285 A1 6/2006 Thayer

* cited by examiner

*Primary Examiner*—David P Porta
*Assistant Examiner*—Benjamin Schmitt
(74) *Attorney, Agent, or Firm*—Fay Sharpe LLP

(57) ABSTRACT

Systems and methods are described that facilitate replacing cleaning blades employed to chisel excess toner from a photoreceptor surface. For example, a cleaning unit can comprise a blade holder with a plurality of cleaning blades attached thereto, which is rotated (e.g., by an actuator) to remove a used cleaning blade from the photoreceptor surface and position a new cleaning blade against the photoreceptor surface. Blade replacement can be triggered by a detected defect on an output image or by detected excess toner on the photoreceptor surface downstream from the cleaning blade. Additionally, blade replacement can be triggered as a function of blade use (e.g., measured in time, prints, photoreceptor cycles), friction force on the blade, or a combination thereof, to achieve a desired (e.g., low) cleaning unit failure probability.

18 Claims, 7 Drawing Sheets

LONG LIFE CLEANING SYSTEM WITH REPLACEMENT BLADES

BACKGROUND

The subject application relates to xerographic imaging, and more particularly to cleaning residual toner from an imaging device surface, etc.

Electrophotographic applications such as xerography employ an electrostatic surface of a photoreceptor that is charged and exposed to a light pattern representing an original image, which selectively discharges the photoreceptive surface. The resulting pattern of charged and discharged areas on the photoreceptor surface form an electrostatic pattern (an electrostatic latent image) of the original image. Toner is applied to, and adheres to, the image areas by the electrostatic charge on the surface, forming a toner image. The toner image may then be transferred to a substrate to form a reproduction of the image. The process is useful for light lens copying from an original image as well as printing applications from electronically generated or stored originals.

"Blade cleaning" is a technique for removing toner and debris from a photoreceptor. In a typical application, a relatively thin elastomeric blade member is supported adjacent to and transversely across the photoreceptor surface with a blade edge that chisels or wipes toner from the surface. Toner accumulating adjacent to the blade is transported away from the blade area by a toner transport arrangement or by gravity. Blade cleaning is advantageous over other cleaning systems due to its low cost, small cleaner unit size, low power requirements, and simplicity. However, conventional blade cleaning systems suffer from short life due to early, random failures. Attempts to identify blade materials that possess better reliability and enable dramatic life improvements have not been successful. Introduction of additional blade lubrication can significantly improve blade reliability and life, but adverse interactions with other xerographic systems frequently occur. The introduction of photoreceptor surface coatings has improved photoreceptor life, but these coatings typically result in far higher blade wear rates. Improvements from the introduction of additional lubrication are typically more than offset by the use of coated photoreceptors.

Accordingly, there is an unmet need for systems and/or methods that facilitate overcoming the aforementioned deficiencies.

BRIEF DESCRIPTION

In accordance with various aspects described herein, systems and methods are described that facilitate cleaning a photoreceptor surface in a xerographic imaging device using cleaning blades. For example, a cleaning apparatus for a moving photoreceptor surface comprises a cleaning unit with a blade holder that rotates about a pivot point, a first cleaning blade that is coupled to the blade holder and is positioned at an acute angle adjacent to photoreceptor surface to chisel excess toner from the photoreceptor surface, and which cleans excess toner from the photoreceptor surface, and at least one replacement cleaning blade coupled to the blade holder. The apparatus further comprises a sensor that senses a blade-switching condition and triggers a cleaning blade replacement, and an actuator that rotates the blade holder about the pivot point to remove the first blade from contact with the photoreceptor surface and positions the at least one replacement blade adjacent to the photoreceptor surface upon detection of a switching condition.

According to another aspect, a method of replacing cleaning blades in a photoreceptor cleaning unit comprises employing a predefined blade replacement schedule, detecting a blade replacement condition in a cleaning unit coupled to a photoreceptor surface, and rotating a blade holder about a pivot point to remove a used blade from contact with the photoreceptor surface and to bring a replacement blade into operational contact with the photoreceptor surface upon detection of the blade replacement condition. The cleaning blades chisel excess toner from the photoreceptor surface.

Yet another aspect relates to a printing platform, comprising a printer with a photoreceptor surface to which toner is applied during generation of an image, a cleaning unit with a blade holder to which multiple cleaning blades are attached to chisel excess toner from the photoreceptor surface, and a sensor that monitors one or more of toner accumulation downstream from a current cleaning blade that is in operational contact with the photoreceptor surface or print defects on an output image, to detect a blade replacement condition. The print platform further comprises an actuator that rotates the blade holder about a pivot point to remove the current cleaning blade from the photoreceptor surface and position a new cleaning blade in operational contact with the photoreceptor surface, in response to a detected blade replacement condition.

DETAILED DESCRIPTION

In accordance with various features described herein, systems and methods are described that facilitate removing residual toner from an imaging device surface, such as a photoreceptor. A cleaning unit is described that contains one or more replacement blades in addition to an initially used blade. Blade replacement is executed by rotation of a holder to retract the initial blade from use and bring a new blade into operational contact with the photoreceptor. Initiation of a blade replacement may be based on usage (prints, cycles, accumulated stress, etc) and/or blade failure. Failures can be detected by sensors within the machine or by an operator. Additionally, blade replacement can be performed by machine actuators or by the operator.

Figure 1:
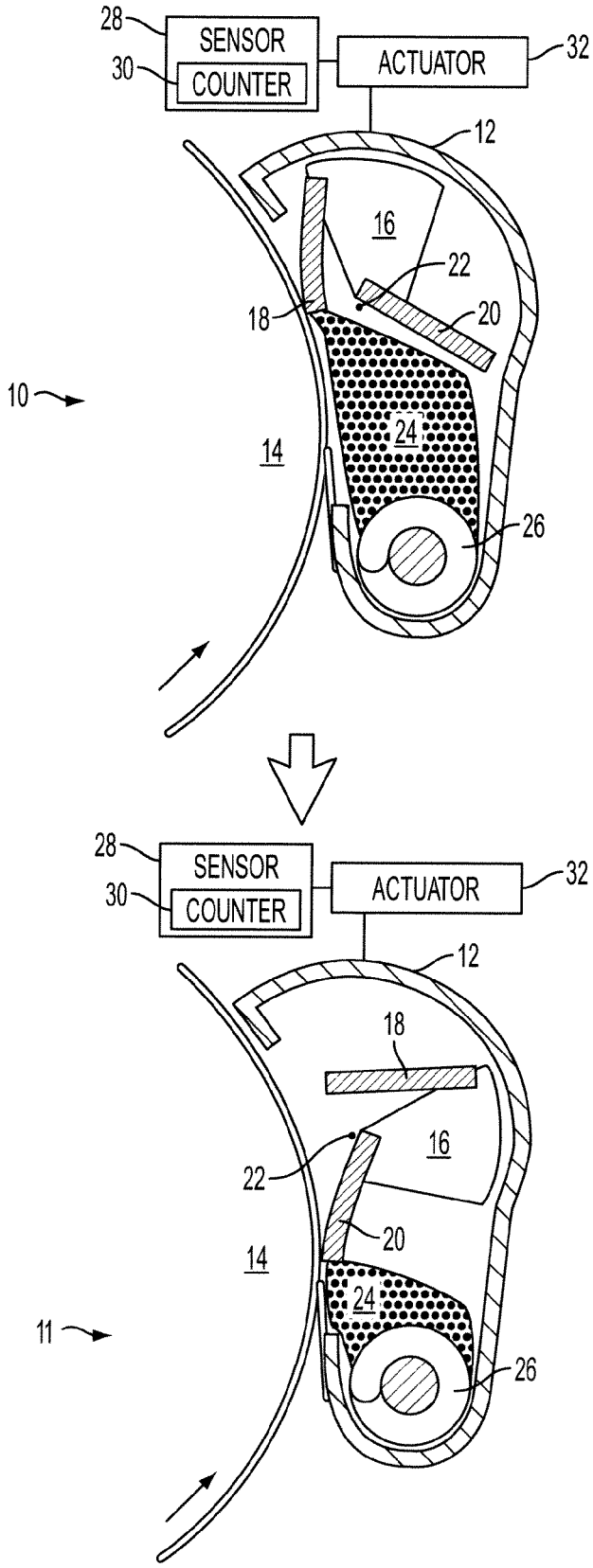
FIG. 1, a system is illustrated that facilitates replacing a used cleaning blade with a cleaning blade at the end-of-life (EOL) of the used cleaning blade, or at any other desired replacement time.

With reference to FIG. 1, a system is illustrated that facilitates replacing a used cleaning blade with a cleaning blade at the end-of-life (EOL) of the used cleaning blade, or at any other desired replacement time. The system is illustrated in a first orientation 10 wherein the first cleaning blade is in use, and in a second orientation 11, wherein the second cleaning blade is in use. The system comprises a cleaner unit 12, that is in operational contact with a photoreceptor 14, and houses a blade holder 16, which in turn has a first blade 18 and a second blade 20 attached thereto. The blade holder 16 pivots about a pivot point 22 to position the first or second blade against the surface of the photoreceptor 14, which has a direction of rotation indicated by the arrow at the bottom of the photoreceptor 14 (e.g., counterclockwise in this example). The blade, when placed against the surface of the photoreceptor 14, removes excess waste toner 24, which is directed toward a toner removal auger 26 that removes the waste toner 24 from the cleaner unit 12. Waste toner 24 may then be discarded, recycled, etc.

The system further comprises a sensor 28 that senses status information related to print quality, toner build-up, blade wear, or any other suitable parameter for determining an appropriate time for switching blades. The sensor can comprise one or more counters 30 that facilitate determining when to change a blade. An actuator 32 performs the blade change, and may be manual (e.g., a knob, lever, cam, or other actuating means that an operator manipulates to effectuate the blade change) or automatic (e.g., a motor, solenoid, etc.) that changes the blade in response to a sensed blade change condition.

Thus, the system comprises a compact cleaning blade unit having two or more blades that are positioned so that toner flow is not impeded and so that accumulated toner does not apply pressure to the operating blade. Simple rotation of the blade holder removes a used blade and replaces it with a new blade. The photoreceptor surface can be stationary or moving backwards from normal operation during blade replacement. The sensor 28 detects accumulated blade use in one or more ways. For instance, the counter 30 can measure blade use as a function of a number of prints and/or as a function of photoreceptor cycles.

Additionally or alternatively, the counter 30 can measure blade use as a function of accumulated stress. For instance, the sensor 28 can measure blade friction force. In one example, the sensor includes a force transducer (not shown) mounted to the blade holder. In another example, the sensor 28 measures photoreceptor drive torque, and includes a counter to measure photoreceptor cycles or prints and a counter or other digital logic to sum friction force times photoreceptor cycles or prints.

In still another example, the counter 30 measures blade use as a function of image pixels. In this example, the sensor 28 includes a counter to sum pixels across the process width, and one or more counters to sum pixels in designated process direction bands.

According to other features, the sensor 28 detects cleaning failures, such as cleaning defects on the output image, toner streaks past the cleaning blade edge on the photoreceptor surface. In this example, the sensor can comprise full width arrays of micro-densitometers or the like, which monitor the photoreceptor surface in real time (e.g., without requiring multiple passes over the photoreceptor surface).

Blade replacement strategy can comprise one or more replacement schemes based on blade use, run-to-failure schemes, and the like. For example, replacement strategies based on blade use can comprise analysis of cleaning unit failure probability at end of life specified (e.g., by a customer, by design constraints, etc.) Individual blades can additionally be replaced at intervals desired to achieve a specific cleaning unit failure probability.

Another replacement strategy for an N-blade system includes replacing the first Nn−1 blades based on use and replacing the Nth blade upon failure. In such a scenario, failure at end of cleaning unit life is deemed acceptable, cleaning unit failure probability for N−1 blades can be pre-specified, and individual blade replacement can be performed at predetermined intervals to achieve a desired N−1 blade failure probability.

In yet another replacement strategy, all blades are permitted to run to failure. According to one example, machine sensing of cleaning failures need not be employed, such as where failure of each individual blade is acceptable. In another example, cleaning failures are sensed by the machine. For instance, failures can be detected when they are minor print defects, on photoreceptor before they appear on prints, etc.

According to an example, blade replacement is enabled by rotation of the blade holder 16 about the pivot point 22 (e.g., as effectuated by an automatic or manual actuator 32). Although a two-blade cleaning system is shown, it will be appreciated by those of skill that the concept can be extended to more than two blades (see, e.g., FIG. 6). According to various features, the blade holder 16 can comprise N blades, where N is an integer greater than or equal to 2 and is constrained only by blade thickness, cleaner unit size, blade holder size, and blade length. Use of more than two blades may increase the size of the cleaning unit, although thinner and/or shorter blades can facilitate increasing blade number while maintaining a constant cleaner unit size. For the example shown, less than 90° of blade holder 16 rotation is employed to remove the used cleaning blade 18 from the photoreceptor 14 and replace it with the second blade 20, which is illustrated by the transition from the first orientation 10 to the second orientation 11. The second blade 20, although not in the same location on the surface of the photoreceptor 14 as the first blade 18, has the same orientation to the photoreceptor 14 such that blade interference, load, and working angle are the same. The blades are positioned so that flow of waste toner 24 from the blade in use is not impeded by the blade(s) that are not being used. This feature mitigates toner bridging above the waste auger 26, as well as a need to apply pressure to the blade in use.

The example shown in FIG. 1 exchanges used blades for new blades by rotating the blade holder 16 so that the blades move against the photoreceptor in the direction of photoreceptor rotation, which may result in some over-bending of the used blade as it is replaced. However, since the used blade is no longer useful, the over-bending of the blade is not harmful to operation of the cleaning unit 12. During replacement of the blades, the photoreceptor may be stopped, if desired, to limit the amount of toner that remains on the photoreceptor 14, downstream of the second blade, to the amount toner between the operational position of the first blade 18 and the operational position of the second blade 20.

According to another example, the photoreceptor 14 can be backed up the short distance between the operational positions of the first and second blades so that toner remaining in front of the first blade 18 is moved upstream of the operational position of the second blade 20. Backing up the photoreceptor 14 can further decrease or eliminate the amount of toner that remains on the photoreceptor 14 downstream of the second blade 20 after blade replacement.

Once the first blade 18 has been rotated away from the photoreceptor 14, and the second blade 20 has been brought into its operational position, the first blade can be prevented from returning to its original operational position (e.g., by reversing the blade rotation), if desired. This feature can be effectuated by the high friction force and steep angle of the second blade 20, which resists moving against the stationary photoreceptor surface.

Alternatively, if the photoreceptor 14 surface is moving in the same direction as the blade holder 16, then the first blade 18 can be rotated back into operational contact with the photoreceptor 14. If the photoreceptor speed is equal to or greater than the speed of the first blade tip as it is rotated into operational position, then no damage to the blade occurs. Minimal over-bending may cause a small temporary decrease in blade load due to blade set, which is temporary. Recovery from blade set can occur over a period of time approximately equivalent to the amount of time that the blade experiences deformation. Since the time period to exchange blades is short, the blade set recovery time is proportionally short.

Figure 2:
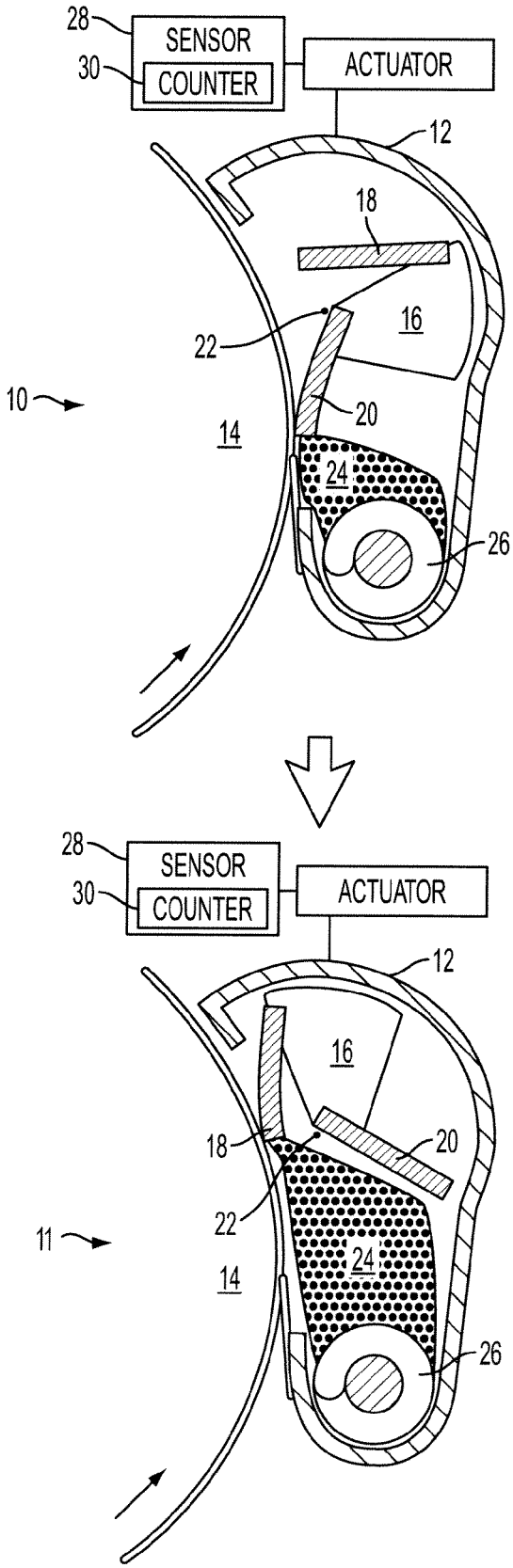
FIG. 2 is an illustration of a system that facilitates replacing a used blade with a fresh blade while reversing a direction of photoreceptor rotation, in accordance with various aspects.

FIG. 2 is an illustration of a system that facilitates replacing a used blade with a fresh blade while reversing a direction of photoreceptor rotation, in accordance with various aspects. In machines where reversing the direction of the photoreceptor is possible, a second blade replacement strategy can be employed. According to an example, the second blade of FIG. 1 is used first, as the original cleaning blade. The photoreceptor 14 direction is reversed during replacement of the original blade. Thus, the system begins in orientation 11, and proceeds to orientation 10 when the blades are switched.

By rotating the blade holder in a direction opposite (e.g., clockwise in this example) to the operational direction of rotation of the photoreceptor 14 (e.g. counterclockwise in this example), and by reversing the rotational direction of the photoreceptor 14 during blade switching, toner can be prevented from escaping from the cleaning unit 12 during the blade replacement process. All of the surfaces of the replacement blade 18 remain free of toner prior to being used in this example.

A number of strategies (e.g., blade replacement schedules) are possible for determining when to replace blades within the cleaning unit. For an individual blade, the blade can be replaced upon detection of a blade replacement condition, such as blade failure, a predetermined amount of use, etc. Blade failure can be detected by the machine operator or by a sensor within the machine. For example, the sensor 28 can observe failures on prints or on the photoreceptor 14. By observing cleaning failures on the photoreceptor 14 after employment of the cleaning blade but prior to development, cleaning failures can be detected before they appear on prints. This is so because many development systems scavenge toner from the photoreceptor. Small amounts of toner that remain on the photoreceptor after passing by the cleaning blade can be removed during the development process with no detrimental impact on print quality. When the amount of toner remaining on the photoreceptor after the cleaning blade becomes greater than the amount that can be scavenged by the development system, defects can appear on the prints. A number of sensors are available that are capable of detecting the presence of toner from blade failures on the photoreceptor surface or on prints. In one example, the sensor 28 is an array of micro-densitometers that extend across the width of the xerographic process.

Blades may also be replaced after a predetermined number of prints, photoreceptor cycles, or accumulation of stress. This strategy is desirable when life of the blade is sufficiently predictable. If blade life is not predictable (e.g., has a Weibull slope near 1), then a run-to-failure strategy may be employed. Blade replacement at a predetermined interval can be employed in scenarios where the time between replacements is sufficiently long and the probability of failure before that interval is sufficiently small. Typically, less than 5% to 10% of the blade population fail before the replacement interval, which is the time between blade changes. The required length of the replacement interval may be chosen to be compatible with other machine components and to enable a desired service or running cost for the machine. For example, if a print cartridge containing a blade needs to have a B10 life of 400,000 cycles in order to meet run cost goals, then the blade may be required to have only 5% failures at 400,000 cycles. For a blade with a near-random failure distribution, a very large median blade life is required in order to meet such a target (e.g., a B5 of 400,000 cycles and a Weibull slope of 1 implies a characteristic life of 7,798,290 cycles and a B50 of 5,405,363 cycles). For a more symmetric failure distribution (e.g., near normal), the median blade life required to meet the target can be much smaller (e.g., a B5 of 400,000 cycles and a Weibull slope of 3 implies a characteristic life of 1,076,564 cycles and a B50 of 952,756 cycles).

Figure 3:
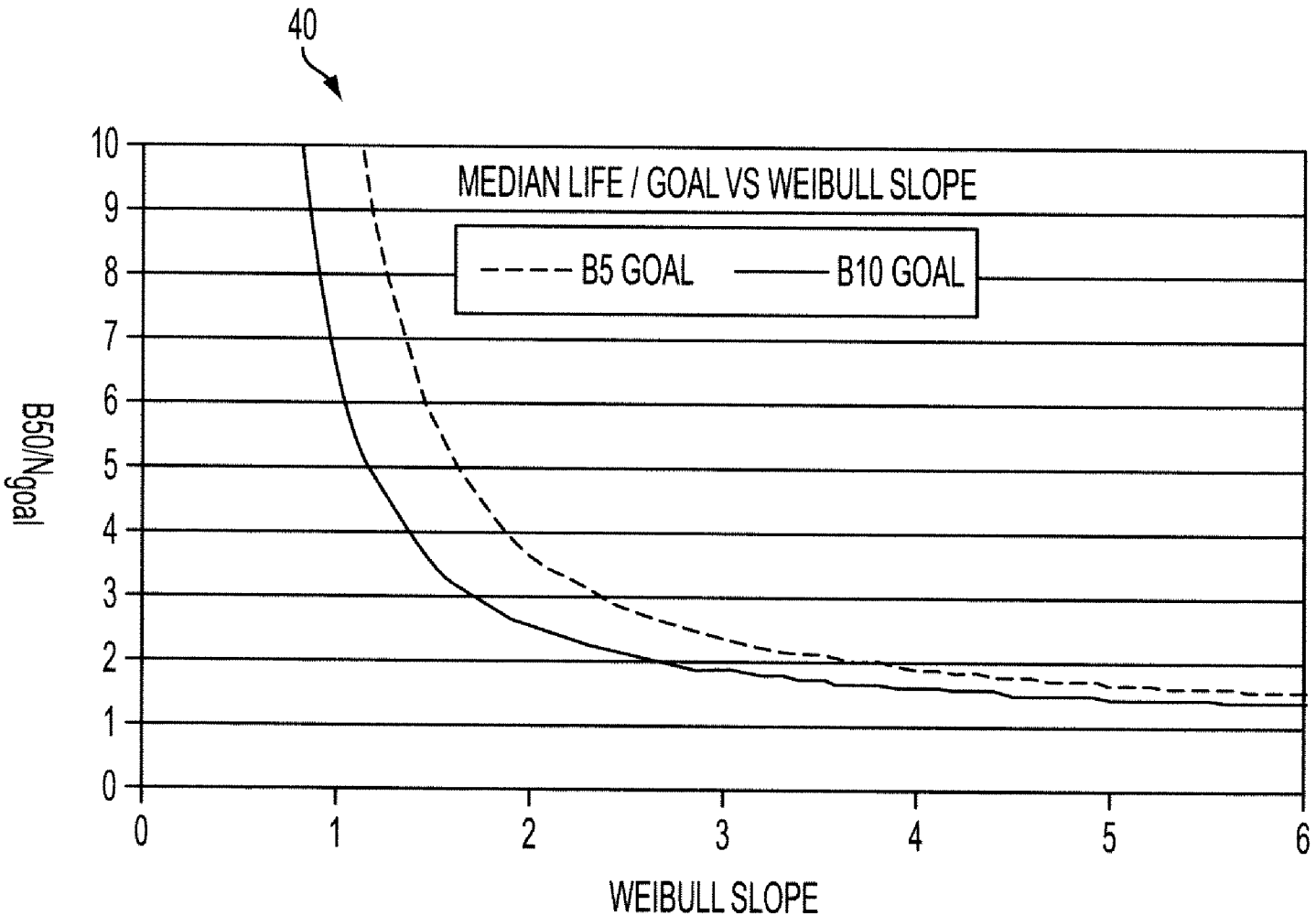
FIG. 3 shows a graph of the ratio of median blade life over the life goal as a function of Weibull slope.

FIG. 3 shows a graph 40 of the ratio of median blade life over the life goal as a function of Weibull slope. For Weibull slopes less than approximately 2 or 3, the desired median blade life to meet the goal is more than twice the goal. As the Weibull slope becomes smaller, it becomes increasingly difficult to achieve these very high median lives. Assuming a sufficiently predictable failure distribution, blades may be replaced after a predetermined number of prints.

Photoreceptor cycles for process cycle-up and cycle-out occur at the beginning and end of every job. If a machine typically runs short jobs, it will generate more photoreceptor cycles per print than a machine that typically runs longer jobs. The machine running long jobs will have put fewer cycles on a blade than the machine running short jobs when they reach the blade replacement interval in prints. For this reason, blade replacement intervals based on photoreceptor cycles rather than prints is can be desirable. Blade replacements based on photoreceptor cycle count can have greater certainty regarding the amount of blade use than replacements based on print count.

Blade replacements based on accumulated stress can have more certainty in the amount of blade use than replacements based on photoreceptor cycle count, since blade stress is induced by the friction force between the blade and the photoreceptor. Higher friction forces, created by low lubrication conditions, generate higher stresses in the blade. Initial lubrication for the blade edge is supplied by a lubricant coating of the blade edge. For example, PMMA (polymethylmethacrylate) is a commonly used initial blade lubricant coating. Once the initial lubricant coating has worn away, blade lubrication is dependent on the quantity of toner, toner additives, paper debris and other particulates on the surface of the photoreceptor. The hardness and texture of the photoreceptor surface also influence the blade-photoreceptor friction. Blade stress can be inferred by measuring the friction force on the cleaning blade. A measurement of the total friction force across the full width of the blade represents an average of the locally varying friction forces acting on the blade edge. Integration of the friction force over the number of photoreceptor cycles is equivalent to the energy applied to the blade edge, which can be correlated to wear of the blade edge and failure to clean.

Knowledge of cross-process variations in the friction force can be utilized to further reduce uncertainty in the accumulated stress contributing to cleaning failures. Local regions of the blade edge that consistently receive little toner lubrication can be expected to wear at higher rates than regions of the blade where toner lubrication is high. Measurement of the average friction force does not describe the distribution of forces along the length of the blade. Measurement of friction force distribution through multiple sensors is not only expensive, but often does not achieve sufficient resolution to enable significant improvement over an average friction force measurement. Toner lubrication conditions along the length of the blade can be inferred from knowledge of the distribution of post-transfer residual toner on the photoreceptor. With digital printing machines, this information is available from the location of exposed pixels on the photoreceptor surface. For instance, by counting the number of pixels that are exposed, developed, and transferred in each region of the blade edge, the distribution of toner lubrication can be inferred. Counters can record accumulated blade stress for each region along the blade edge. The counters can be interrogated to determine whether the most highly stressed region of the blade is approaching the accumulated stress level that triggers blade replacement. When this accumulated stress level has been reached, the blade can be replaced. The accumulated stress level that triggers replacement can be selected to correspond to a predetermined probability of blade failure (e.g., 5% of blades expected to reach failure prior to this level).

In a cleaning unit having replacement blades, the blades may be replaced by any combination of the above-described run-to-failure (RTF) and use strategies described above. Table 1, below, lists examples of combinations of replacement strategies that can be used for a two blade cleaning unit. Also listed are examples of lives expected from each blade and the combined cleaning unit life. In the presented examples, a blade with a run-to-failure replacement strategy is assumed to be replaced at the median (B50) life, although other points in the blade life cycle may be used. A blade replaced after a predetermined amount of use is assumed to be replaced at the B5 life (i.e., 5% blade population fails before this life), although other points (e.g., B10, B12, B15, etc.) may be used. Additionally, examples of probabilities of cleaning failures are listed. The first of the final two columns lists a probability of a cleaning failure before the cleaning unit has reached end of life (EOL), which is the probability of the first blade failing before EOL. The last column is the probability of a failure sometime during the life of the cleaning unit.

TABLE 1

Two blade cleaning unit life for all blade replacement strategy combinations.

| | Blade Replacement Strategies | | Expected Lives | | | Cleaning Unit Failure Prob. | |
|---|---|---|---|---|---|---|---|
| | Blade 1 | Blade 2 | Blade 1 | Blade 2 | Cleaning Unit | Before EOL | At EOL |
| 1 | Use | Use | B5 | B5 | 2 B5 | 5% | 9.75% |
| 2 | Use | RTF | B5 | B50 | B5 + B50 | 5% | 100% |
| 3 | RTF | Use | B50 | B5 | B5 + B50 | 100% | 100% |
| 4 | RTF | RTF | B50 | B50 | 2 B50 | 100% | 100% |

Example combination 1 in Table 1 has the shortest cleaning unit life of the exemplified combinations but the lowest probability of at least one cleaning failure. Example combination 4 has the longest cleaning unit life but has two cleaning failures. Running the first blade to failure and then stopping the second blade before failure typically yields little or no advantage; therefore, example combination 2 will typically be preferred to example combination 3. In a scenario where it is acceptable to end the life of the print cartridge with a cleaning blade failure, then the "before EOL" cleaning unit failure probabilities can be used for comparisons. In an example where, at end of life, the cleaning unit failure probability is desired to be 5%, then the blades in example combination 1 can to be replaced at the B2.5 life.

For a failure distribution with a predictable, sharp failure point (e.g., a high Weibull slope) example combination 1 may be an optimal choice. Although the cleaning unit life is short, the B5 and B50 lives are not significantly different. Trading off a small increase in cleaning unit life may be worth the large reduction in the probability of a cleaning failure. Such a replacement scheme can be desirable for customers who do not want to experience a single failures (e.g., the other three combination examples may have at least one failure). The remaining combination examples may be desirable for customers who are willing to trade off an occasional cleaning failure that is quickly remedied for much longer print cartridge life and lower run costs.

If the failure distribution is not predictable or sharp, then example combination 4 may be an optimal replacement scheme. For machines having replaceable blades with random failure modes, run-to-failure has been the traditional blade service strategy. For print cartridge machines, such blades would only be used in very short-life cartridges. Because failure of the cleaning blade typically requires replacement of the entire print cartridge, it is desirable that blades have higher reliability in longer life cartridges.

Long print cartridge life can be achieved when cleaning units containing multiple blades are used, as described herein. For example, after running the first blade to failure, a machine operator can manually replace a failed blade by rotating a knob or other device (e.g., electronic, electrical, mechanical, etc.) that achieves the desired blade replacement. Additionally or alternatively, the operator can inform a machine controller of the failure and the machine controller can automatically replace the failed cleaning blade. In another example, the machine senses a cleaning failure before it is apparent to the operator, and then automatically replaces the failed blade. In higher speed and higher print volume machines, reliability and optimal duty cycle are high customer priorities and can be facilitated by the replacement schemes described herein. In the case of tandem color machines having print cartridges for each color, a single sensor on the output image can detect which of the four cleaning blades (e.g., red, green, blue, and clear; cyan, magenta, yellow, and key; etc.) has failed. The cost of cleaning failure sensing in such scenarios can be one quarter the cost of using four sensors.

Table 2 lists examples of replacement strategy combinations for a three-blade cleaning unit. The results for a three blade cleaner unit are similar to those for a two blade cleaner unit.

TABLE 2

Three blade cleaning unit life for all blade replacement strategy combinations.

| | Blade Replacement Strategies | | | Expected Lives | | | | Cleaning Unit Failure Prob. | |
|---|---|---|---|---|---|---|---|---|---|
| | Blade 1 | Blade 2 | Blade 3 | Blade 1 | Blade 2 | Blade 3 | Cleaning Unit | Before EOL | At EOL |
| 1 | Use | Use | Use | B5 | B5 | B5 | 3 B5 | 9.75% | 14.3% |
| 2 | Use | Use | RTF | B5 | B5 | B50 | 2 B5 + B50 | 9.75% | 100% |
| 3 | RTF | Use | Use | B50 | B5 | B5 | 2 B5 + B50 | 100% | 100% |
| 4 | Use | RTF | Use | B5 | B50 | B5 | 2 B5 + B50 | 100% | 100% |
| 5 | RTF | RTF | Use | B50 | B50 | B5 | B5 + 2 B50 | 100% | 100% |
| 6 | RTF | Use | RTF | B50 | B5 | B50 | B5 + 2 B50 | 100% | 100% |
| 7 | Use | RTF | RTF | B5 | B50 | B50 | B5 + 2 B50 | 100% | 100% |
| 8 | RTF | RTF | RTF | B50 | B50 | 850 | 3 B50 | 100% | 100% |

Table 3 lists the replacement strategy combinations for an N-blade cleaner unit, where N is an integer. Three examples of blade replacement strategies are shown.

TABLE 3

Multiple blade cleaning unit life for blade replacement strategies.

| | Blade Replacement Strategies | | Expected Lives | | | Cleaning Unit Failure Prob. | |
|---|---|---|---|---|---|---|---|
| | Blades 1 to n − 1 | Blade n | Blades 1 to n − 1 | Blade n | Cleaning Unit | Before EOL | At EOL |
| 1 | Use | Use | B5 | B5 | n B5 | $1 - (0.95)^{n-1}$ | $1 - (0.95)^{n}$ |
| 2 | Use | RTF | B5 | B50 | (n − 1) B5 + B50 | $1 - (0.95)^{n-1}$ | 100% |
| 3 | RTF | RTF | B50 | B50 | n B50 | 100% | 100% |

Table 4 lists the three examples of blade replacement strategies of Table 3, and the impact of failure sensing on whether or not these strategies will meet exemplary design requirement. For sensors that detect failures before they appear on prints, the run-to-failure replacement strategy enables long life, low run cost and no failures experienced by the customer.

TABLE 4

Blade replacement strategy and customer requirements.

| Blade Replacement Strategy | No Failure Sensing | Failure Sensing |
|---|---|---|
| All blades at B5 | Customer willing to trade long life and low run cost for no failures | Some benefit |
| First blades at B5 & last blade RTF | Failure acceptable on last blade | Some benefit |
| All blades RTF | Customer willing to trade failures for long life and low run cost | Acceptable to all customers - long life & low run cost without failures |

Figure 4:
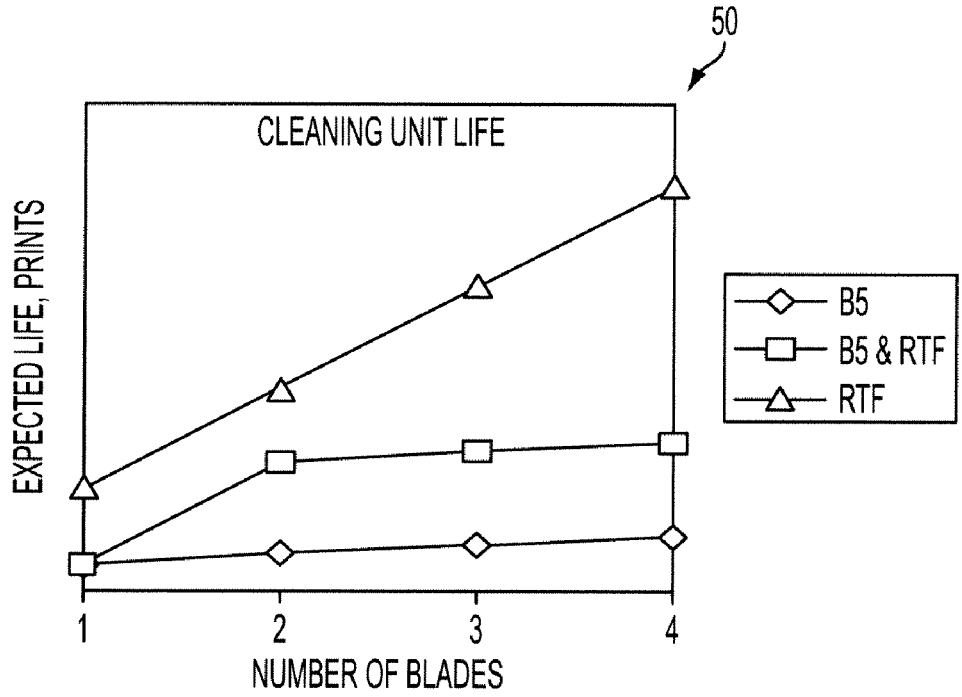
FIG. 4 is a graph of expected cleaning unit lives with various blade replacement strategies for a typical cleaning blade material.

FIG. 4 is a graph 50 of expected cleaning unit lives with various blade replacement strategies for a typical cleaning blade material. As can be seen, the run-to-failure strategy provides the longest life for respective blades, while the B5 strategy exhibits shorter blade life with improved duty cycle (e.g., blades are replaced before they fail, thereby reducing system down-time).

Figure 5:
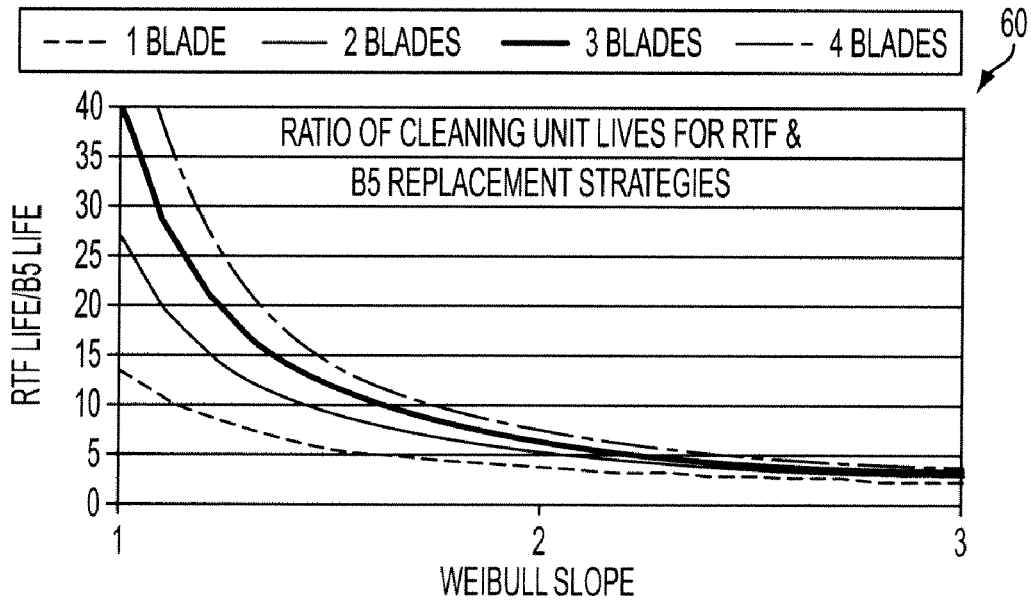
FIG. 5 is a graph illustrating the ratio of the run-to-failure replacement strategy life to the B5 replacement strategy life.

FIG. 5 is a graph 60 illustrating the ratio of the run-to-failure replacement strategy life to the B5 replacement strategy life. Relative to FIG. 4, the graph 60 represents the plotted triangles divided by the plotted diamonds. In FIG. 5, however, the ratio is shown as a function of the Weibull slope and the number of blades in the cleaning unit. As the Weibull slope increases, blade failure becomes more predictable with a sharper failure onset. As a result, the difference between run-to-failure and B5 replacement strategies becomes smaller for larger Weibull slopes. As the number of blades in the cleaning unit increases, the ratio of run-to-failure replacement lives over B5 replacement lives increases, albeit at a diminishing rate.

Figure 6:
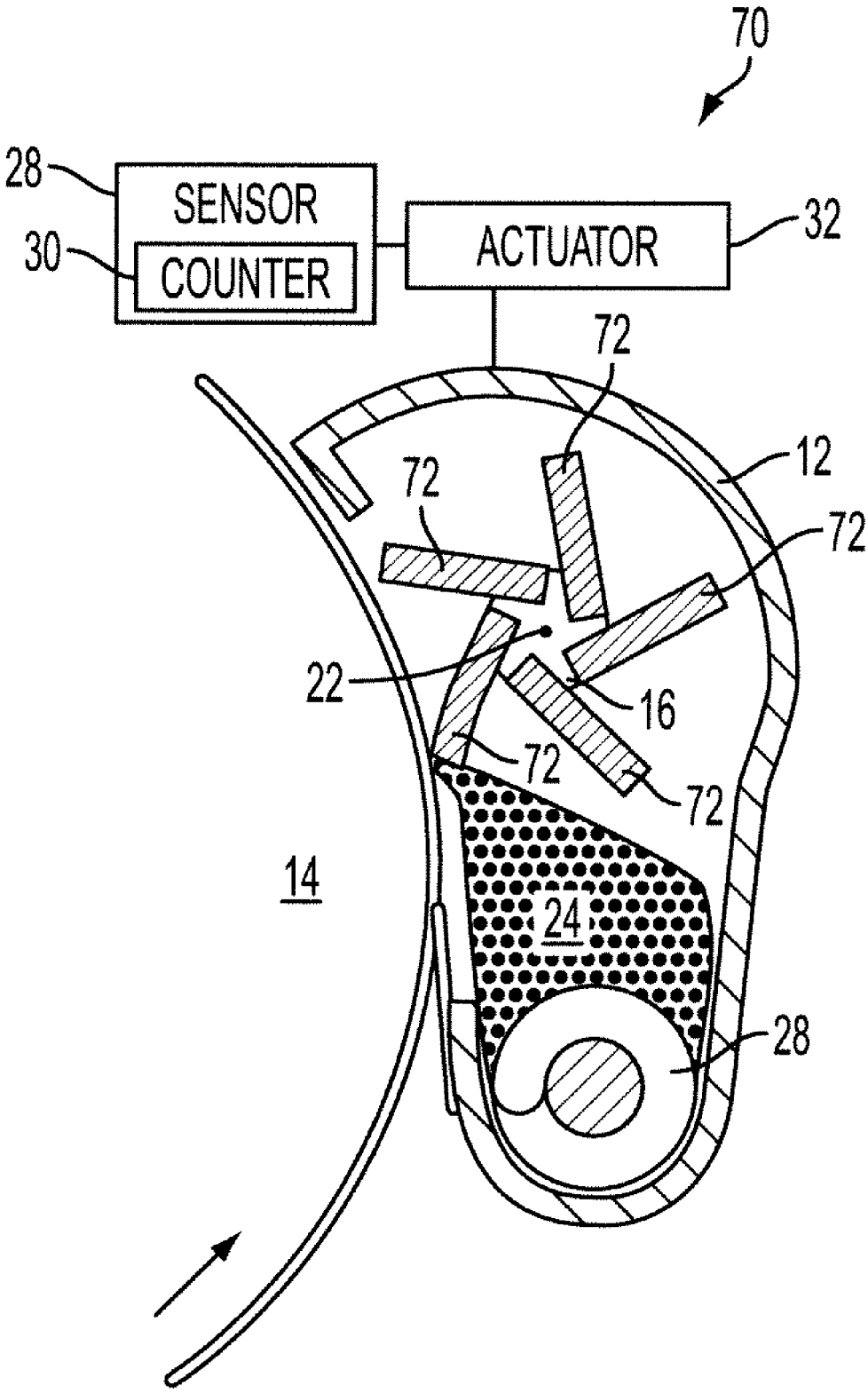
FIG. 6 illustrates a 5-blade system, in which a used blade is rotated out of position and a new blade is concurrently rotated into position, in accordance with various aspects described herein.

FIG. 6 illustrates a 5-blade system 70, in which a used blade is rotated out of position and a new blade is concurrently rotated into position, in accordance with various aspects described herein. The system 70 comprises a cleaner unit 12 coupled to a photoreceptor 14. The cleaner unit 12 includes a blade holder 16, which has five cleaning blades 72 coupled thereto, and rotates about a pivot point 22. Each blade 72, when placed against the surface of the photoreceptor 14, removes excess waste toner 24, which is directed toward a toner removal auger 26 that removes the waste toner 24 from the cleaner unit 12. Waste toner 24 may then be discarded, recycled, etc.

The system 70 further comprises a sensor 28 that senses status information related to print quality, toner build-up, blade wear, or any other suitable parameter for determining an appropriate time for switching blades, as described herein. The sensor 28 can comprise one or more counters 30 that facilitate determining when to change a blade. An actuator 32 performs the blade change, and may be manual (e.g., a knob or other actuating means that an operator manipulates to effectuate the blade change) or automatic (e.g., a motor, solenoid, etc.) that changes the blade in response to a sensed blade change condition.

The 5-blade system 70 facilitates rotating a replacement blade into position such that the replacement blade is located at a same location on the photoreceptor surface as a previous blade. If desired, photoreceptor rotation may be paused during when a replacement blade is rotated into position to facilitate mitigating toner accrual on the photoreceptor during blade replacement.

It will be appreciated that although the system 70 is described and depicted as having five blades, any number of blades (e.g., from 2 to N, where N is an integer) may be employed in conjunction with the various systems and methods described herein.

Figure 7:
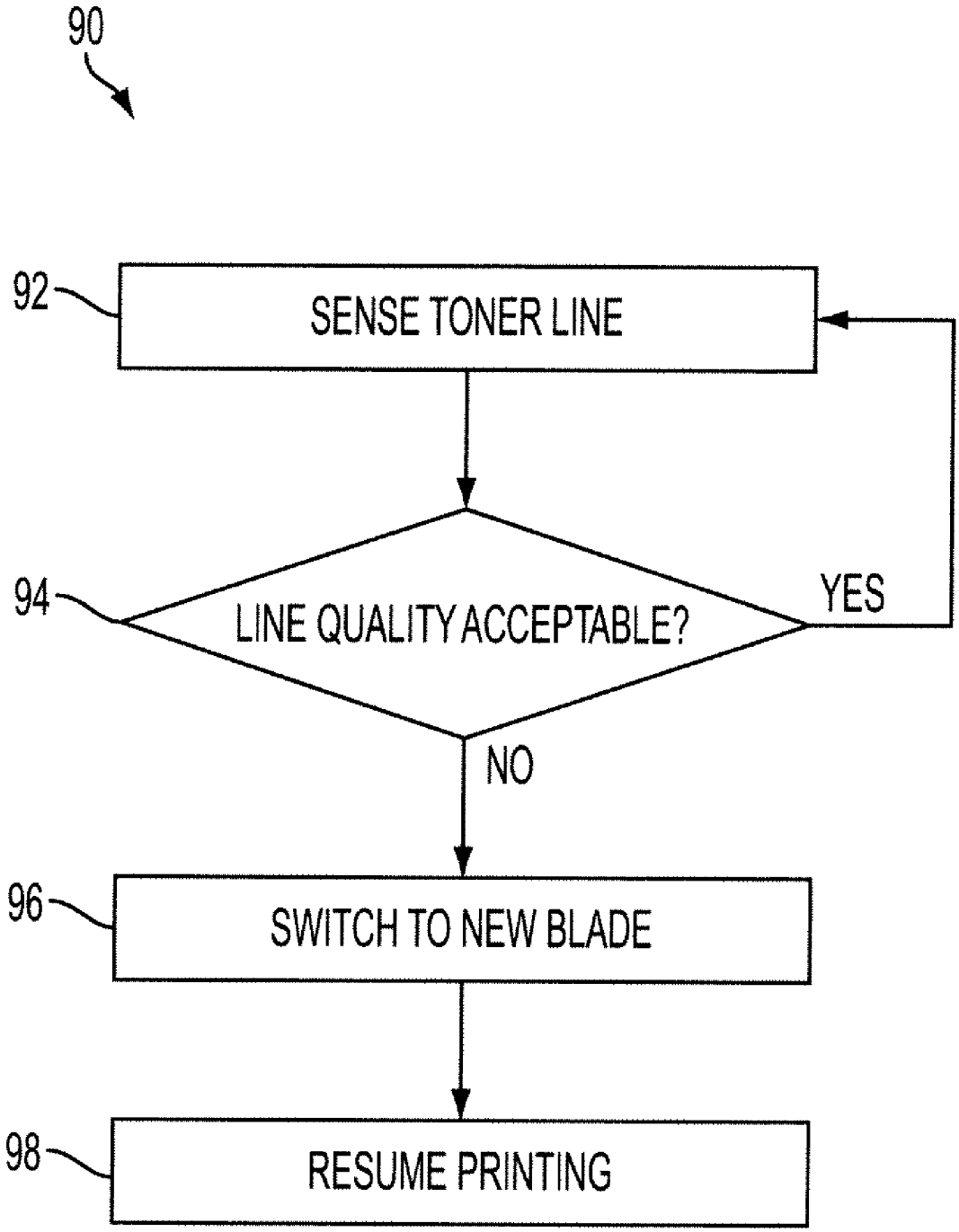
FIG. 7 illustrates a method of determining when to replace a cleaning blade in a multi-blade cleaning system, such as is described with regard to the preceding figures.

FIG. 7 illustrates a method related to performing blade replacement in a multi-blade cleaning system, in accordance with various features described herein. While the method is described as a series of acts, it will be understood that not all acts may be required to achieve the described goals and/or outcomes, and that some acts may, in accordance with certain aspects, be performed in an order different than the specific orders described.

FIG. 7 illustrates a method 90 of determining when to replace a cleaning blade in a multi-blade cleaning system, such as is described with regard to the preceding figures. At 92, a toner line on a photoreceptor is sensed and analyzed. The toner line can be monitored using a single sensor that takes repeated measurements, or by one or more micro-densitometer arrays that concurrently measure the entire photoreceptor surface of interest. At 94, a determination is made regarding whether the toner line quality is acceptable (e.g., above or below a predetermined threshold level of acceptability, quality, etc.; within an acceptable range of values, etc.). If the toner line quality is acceptable, then the method reverts to 92 for continued monitoring. If the toner line quality is determined to be unacceptable, then a blade switching protocol is executed, at 96. Printing resumes, at 98, once the new blade is in place.

Figure 8:
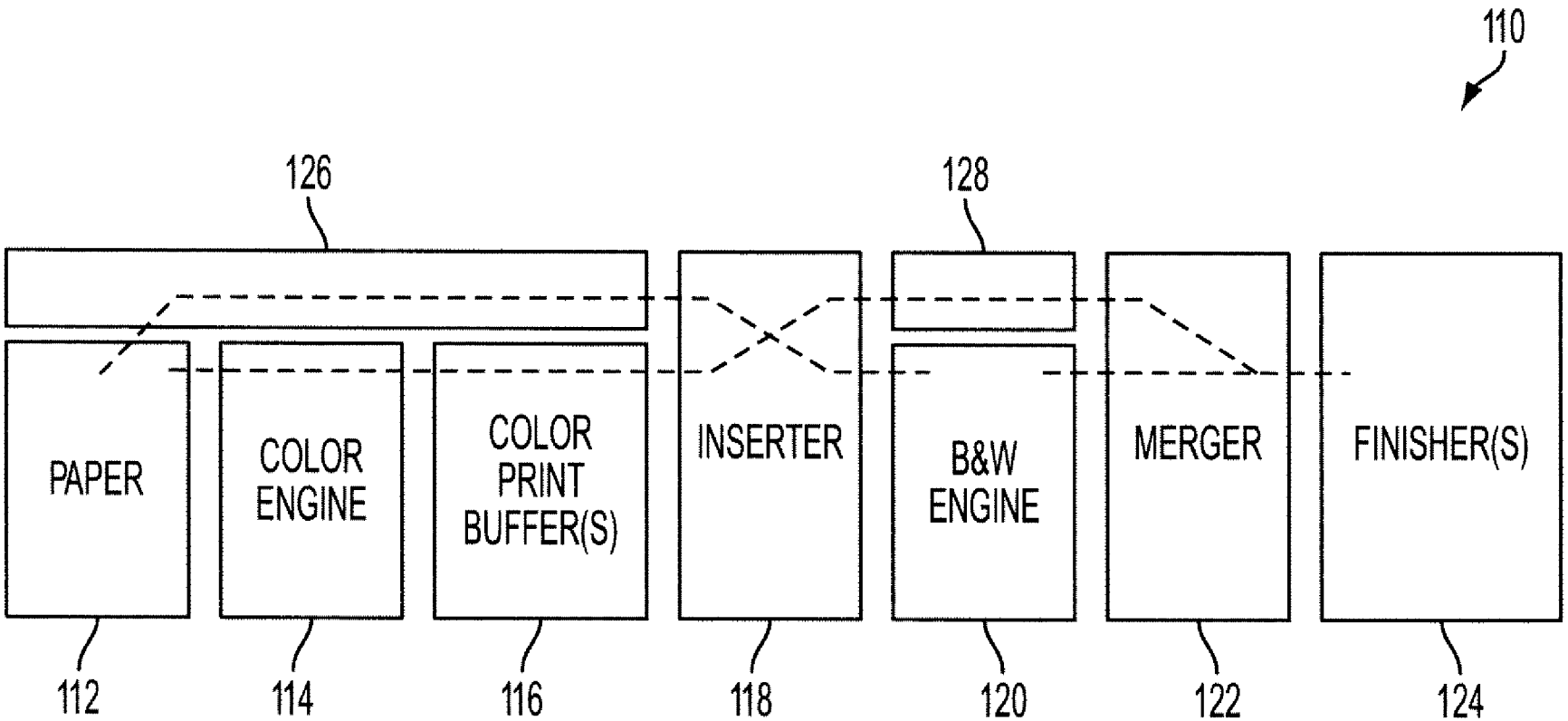
FIG. 8 illustrates a system comprising a plurality of components, such as may be employed in a universal production printer with a color print sheet buffer or a tightly-integrated parallel printer (TIPP) system, which represents an environment in which the various features described herein may be employed.

FIG. 8 illustrates a system 110 comprising a plurality of components, such as may be employed in a universal production printer with a color print sheet buffer or a tightly-integrated parallel printer (TIPP) system, which represents an environment in which the various features described herein may be employed. The system 110 comprises a paper source 112, which may comprise one or more sheets of paper, and which is operatively associated with a color print engine 114 and an inserter 118. Paper from the paper source 112 may follow one of two paths. For instance, paper may be routed from the paper source 112 to the color print engine 114, and on to a color print buffer 116, before entering the inserter 118. Additionally or alternatively, paper may be routed directly from the paper source 112 to the inserter 118 (e.g., bypassing the color engine 114 and the color print buffer 116 using the highway path 126). Similarly, paper may bypass the black and white engine 120 using the highway path 128.

Paper that has been routed directly from the paper source 112 to the inserter 118 may be passed to a black-and-white print engine 120, then through a merger 122 that merges black-and-white and color pages, before proceeding on to a finisher 124 that finishes the document for presentation to a user. It will be appreciated that according to other examples, a page may pass through all components of the system 110 and may have both color portions and black-and-white portions. The actions associated with a job performed by system 110 may be organized into a series of events that define one or more solutions, or "plans," to the job. Alternatively, the second print engine 120 can be a color print engine. Regardless of whether the print engine 120 is black-and-white or color, both print engines 114 and 120 may be outfitted with a cleaning unit, such as the cleaning unit 12 described above.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A cleaning apparatus for a moving photoreceptor surface, comprising:

a cleaning unit with a blade holder that rotates about a pivot point;

a first cleaning blade that is coupled to the blade holder and is positioned at an acute angle adjacent to photoreceptor surface to chisel excess toner from the photoreceptor surface, and which cleans excess toner from the photoreceptor surface;

at least one replacement cleaning blade coupled to the blade holder;

a sensor that senses a blade-switching condition and triggers a cleaning blade replacement; and an actuator that rotates the blade holder about the pivot point to remove the first blade from contact with the photoreceptor surface and positions the at least one replacement blade adjacent to the photoreceptor surface upon detection of a switching condition;

wherein the sensor comprises at least one counter that counts at least one of photoreceptor cycles or prints, a force transducer that measures friction force on the first cleaning blade, and wherein the cleaning blade replacement is triggered as a function of the friction force on the blade and the number of photoreceptor cycles or prints.

2. The apparatus of claim 1, wherein the sensor monitors a toner line on the photoreceptor surface, and triggers the cleaning blade replacement upon a determination that the quality of the toner line exceeds a predetermined threshold value.

3. The apparatus of claim 2, wherein the sensor comprises an array of micro-densitometers that monitors the toner line in real time across the full width of the photoreceptor surface.

4. The apparatus of claim 1, wherein the sensor comprises at least one counter that counts prints, and wherein the cleaning blade replacement is triggered when a predetermined number of prints has occurred.

5. The apparatus of claim 1, wherein the sensor comprises at least one counter that counts photoreceptor cycles, and wherein the cleaning blade replacement is triggered when a predetermined number of photoreceptor cycles has occurred.

6. The apparatus of claim 1, wherein the sensor comprises at least one counter that counts at least one of total pixels printed by the photoreceptor or pixels printed in a pre-designated process direction band, and wherein the cleaning blade replacement is triggered when a predetermined number of pixels have been printed.

7. The apparatus of claim 1, wherein the sensor comprises one or more arrays of micro-densitometers that monitor the width of the photoreceptor surface and detect at least one of cleaning defects on an output image or toner streaks on the photoreceptor receptor surface that has rotated past the edge of the first cleaning blade, and wherein a detected defect or streak triggers a cleaning blade replacement.

8. A method of replacing cleaning blades in a photoreceptor cleaning unit, comprising:

employing a predefined blade replacement schedule;

detecting a blade replacement condition in a cleaning unit coupled to a photoreceptor surface;

rotating a blade holder about a pivot point to remove a used blade from contact with the photoreceptor surface and to bring a replacement blade into operational contact with the photoreceptor surface upon detection of the blade replacement condition; and replacing N−1 used blades as a function of use and permitting an Nth blade to run to failure, where N is the number of blades in the cleaning unit;

wherein the cleaning blades chisel excess toner from the photoreceptor surface.

9. The method of claim 8, wherein the blade replacement condition comprises a defect detected in at least one of an output image and a monitored toner line on the photoreceptor surface.

10. The method of claim 8, wherein the blade replacement condition is pre-specified in the blade replacement schedule.

11. The method of claim 10, further comprising replacing the used blade as a function of blade use, wherein the blade replacement condition is a function of a pre-specified end-of-life (EOL) failure probability for each blade.

12. The method of claim 10, further comprising replacing the used blade as a function of blade use, wherein the blade replacement condition is a function of a predetermined blade use interval that achieves a desired failure probability for the cleaning unit.

13. The method of claim 8, further comprising pre-specifying a cleaning unit failure probability for the N−1 blades.

14. The method of claim 8, further comprising replacing individual blades at predetermined intervals to achieve a desired N−1 blade failure probability.

15. The method of claim 8, wherein the blade replacement condition is a failure of the used blade.

16. The method of claim 15, further comprising detecting one or more print defects to determine whether blade failure has occurred.

17. The method of claim 15, further comprising detecting an unacceptable toner line quality on the photoreceptor surface before the toner line is employed to print an output image, to determine whether blade failure has occurred.

18. A printing platform, comprising:

a printer with a photoreceptor surface to which toner is applied during generation of an image;

a cleaning unit with a blade holder to which multiple cleaning blades are attached to chisel excess toner from the photoreceptor surface;

a sensor that monitors one or more of toner accumulation downstream from a current cleaning blade that is in operational contact with the photoreceptor surface or print defects on an output image, to detect a blade replacement condition; and an actuator that rotates the blade holder about a pivot point to remove the current cleaning blade from the photoreceptor surface and position a new cleaning blade in operational contact with the photoreceptor surface, in response to a detected blade replacement condition;

wherein the sensor comprises at least one counter that counts at least one of photoreceptor cycles or prints, a force transducer that measures friction force on the first cleaning blade, and wherein the cleaning blade replacement is triggered as a function of the friction force on the blade and the number of photoreceptor cycles or prints.

* * * * *